US012808145B2

(12) United States Patent
Gentle et al.

(10) Patent No.: US 12,808,145 B2
(45) Date of Patent: Nov. 24, 2026

(54) METHOD AND SYSTEM OF DITCH EXTRACTION FOR A MOTOR GRADER

(71) Applicant: Caterpillar Inc., Peoria, IL (US)

(72) Inventors: Michael C. Gentle, Maroa, IL (US); Ethan M. Tevis, Bloomington, IL (US); Joshua T. Hayes, Table Grove, IL (US); David L. Cox, Monticello, IL (US)

(73) Assignee: Caterpillar Inc., Peoria, IL (US)

( * ) Notice: Subject to any disclaimer, the term of this patent is extended or adjusted under 35 U.S.C. 154(b) by 574 days.

(21) Appl. No.: 18/464,572

(22) Filed: Sep. 11, 2023

(65) Prior Publication Data

US 2025/0084612 A1 Mar. 13, 2025

(51) Int. Cl.
*E02F 3/84* (2006.01)
*E02F 3/76* (2006.01)

(52) U.S. Cl.
CPC ..... *E02F 3/841* (2013.01); *E02F 3/764* (2013.01); *E02F 3/7645* (2013.01); *E02F 3/7659* (2013.01)

(58) Field of Classification Search
CPC ..... E02F 3/841; E02F 3/844; E02F 3/7636; E02F 3/764
See application file for complete search history.

(56) References Cited

U.S. PATENT DOCUMENTS 6,631,320 B1 10/2003 Holt et al.
7,712,559 B2 * 5/2010 Yeoman ..... E02F 9/0841 180/419
7,766,104 B2 * 8/2010 Newberry ..... E02F 9/2045 180/24.09
8,393,429 B2 * 3/2013 Thomson ..... E02F 9/225 180/209
9,428,884 B2 * 8/2016 Sharma ..... B62D 9/00
9,994,104 B2 * 6/2018 Hertel ..... B60K 28/16
10,428,493 B2 10/2019 Omelchenko et al.
10,550,543 B1 * 2/2020 Ennis ..... E02F 3/7636
10,961,685 B2 * 3/2021 Ono ..... E02F 3/7631
11,305,812 B2 4/2022 Zent et al.
2007/0250236 A1 * 10/2007 Newberry ..... E02F 9/2045 701/51

(Continued)

FOREIGN PATENT DOCUMENTS

CA 2282821 C * 11/2007 ..... F16H 61/4043
EP 3119663 B1 * 5/2020 ..... E02F 9/0841

*Primary Examiner* — Jamie L Mcgowan

(57) ABSTRACT

A system for extracting a motor grader from a location with reduced traction includes the motor grader having articulated front and rear frames supported on front and rear wheels, respectively, and a blade extending from the frame toward the surface underlying the grader. A plurality of blade articulation structures are adapted to articulate the blade relative to the frame. A plurality of sensors are provided and a steering mechanism, power source and control system having a controller. The controller is configured to receive the plurality of signals and perform an extraction procedure to reposition the motor grader. The extraction procedure includes automatic execution of a sequence of operations including a plurality of modification of an articulation angle of the front and rear frames, a steering angle, a position of the blade, a disposition of the blade, propulsion of one or more of the wheels, and direction of propulsion.

18 Claims, 9 Drawing Sheets

(56) References Cited

U.S. PATENT DOCUMENTS

| | | | | |
|---|---|---|---|---|
| 2011/0035109 | A1* | 2/2011 | Ryerson | B62D 53/045 701/42 |
| 2014/0326471 | A1* | 11/2014 | Zhu | E02F 3/765 701/50 |
| 2015/0246612 | A1* | 9/2015 | Velde | B60K 28/16 180/246 |
| 2020/0362535 | A1 | 11/2020 | Veasy et al. | |
| 2020/0362542 | A1 | 11/2020 | Veasy et al. | |
| 2020/0399858 | A1* | 12/2020 | Kobayashi | E02F 9/0841 |
| 2021/0291647 | A1* | 9/2021 | Takase | B62D 11/08 |
| 2025/0084612 | A1* | 3/2025 | Gentle | E02F 3/841 |

* cited by examiner

METHOD AND SYSTEM OF DITCH EXTRACTION FOR A MOTOR GRADER

TECHNICAL FIELD

This patent disclosure relates generally to control of grading operations and, more particularly to a method and system for dislodging a machine from a disposition in a ditch or from a loss of traction during a grading operation.

BACKGROUND

Motor graders are often used for construction, road-building, rural road resurfacing, shallow ditching, field preparation, and other industrial activities requiring the preparation of a flat earthen or particulate surface. A motor grader typically includes a ground engaging element such as a plurality of wheels that convey the machine over the ground, and a large blade extending from the underside of the machine and disposed generally transverse to both the underlying surface and the direction of travel. The blade can generally be manipulated in a plurality of directions and dimensions by the machine operator.

During road building or road maintenance, or where the machine is operating in ditches or on slopes with poor underfoot conditions, the machine may lose traction or otherwise be unable to move. In extreme cases, the machine wheels may begin to slip, causing the motor grader to mar or otherwise cause further unevenness in the surface being treated. In such extreme situations, the further damage may require additional repairs. This can result is a substantial loss of productivity. In some situations, additional equipment may be utilized to extract the motor grader from a location with poor traction.

U.S. Pat. No. 9,994,104 to Hertel, et al., discloses a vehicle traction control system includes a controller operable to monitor wheel slip of at least one of the wheels of a machine. The controller is operable to move the ground-engaging implement at a rate proportional to an amount of wheel slip.

SUMMARY

The described system and method are provided to extract a motor grader from a first location with reduced traction wherein wheel slippage occurs during grading of a surface underlying the motor grader to a second location with comparatively greater traction. The motor grader includes a plurality of configuration parameters, and has a user interface portion configured to provide user input. The motor grader includes a frame including a front frame and a rear frame that are articulated relative to one another, and an articulation mechanism is provided. A plurality of front wheels support the front frame and a plurality of rear wheels support the rear frame, one or more of the front or rear wheels being driven. A grading blade extends from the frame toward said surface underlying the grader. A plurality of blade articulation structures are adapted to articulate the blade relative to the frame. A plurality of sensors are provided. The motor grader further includes a steering mechanism, at least one power source linked to one or more of the wheels to provide propulsion inputs, and a control system including at least one controller. The controller is configured to receive at least one signal including a desired direction of motion of the grader, determine the position of the blade. The controller is further configured to perform an extraction procedure to reposition a plurality of the wheels on the second location with improved traction, the extraction procedure including automatic execution of a sequence of operations including a plurality of adjustment of a current relative articulation angle of the frame, a steering angle, a position of the blade, and propulsion of one or more of the wheels.

According to another aspect of this disclosure, there is provided a method of extracting a motor grader from a first location where wheel slippage occurs to a second location of comparatively greater traction. The motor grader has a front frame supported on a plurality of front wheels and a rear frame supported on a plurality of rear wheels, one or more of the front or rear wheels being driven. The front frame and rear frame are articulated relative to one another. The motor grader further including a blade for grading an underlying ground surface. The method includes selecting a desired direction of motion of the motor grader, determining, via one or more sensors associated with the blade, a blade position including at least one of blade sideshift, blade pitch, blade lift, circle rotation, or drawbar centershift, and initiating a sequence of operations that are then automatically executed by the motor grader to reposition at least a portion of the wheels in the second location of comparatively greater traction. The sequence of operations including a combination of adjusting a current relative articulation angle of the front and rear frames, adjusting a steering angle of the front wheels, and adjusting a position of the blade by at least one of adjusting a current relative articulation angle, a steering angle, the blade sideshift, blade pitch, circle rotation, or drawbar centershift.

According to yet another aspect of this disclosure, there is provided a controller for executing an extraction auto sequence for extracting a motor grader from a first location with reduced traction wherein wheel slippage occurs during grading of a surface underlying the motor grader to a second location of comparatively greater traction. The motor grader has a front frame supported on a plurality of front wheels and a rear frame supported on a plurality of rear wheels, the front frame and rear frame being articulated relative to one another. One or more of the front or rear wheels are driven. The motor grader further includes a blade for grading an underlying ground surface. The controller is configured to receive at least one signal including a desired direction of motion of the grader, determine the position of the blade via one or more sensors, and provide signals to controlling structures of the motor grader to perform an extraction procedure to reposition a plurality of the wheels on in a second location with comparatively greater traction. The extraction procedure includes automatic execution of a sequence of operations including a plurality of adjustment of a current relative articulation angle of the frame, a steering angle, a position of the blade, and propulsion of one or more of the wheels.

DETAILED DESCRIPTION

Figure 1:
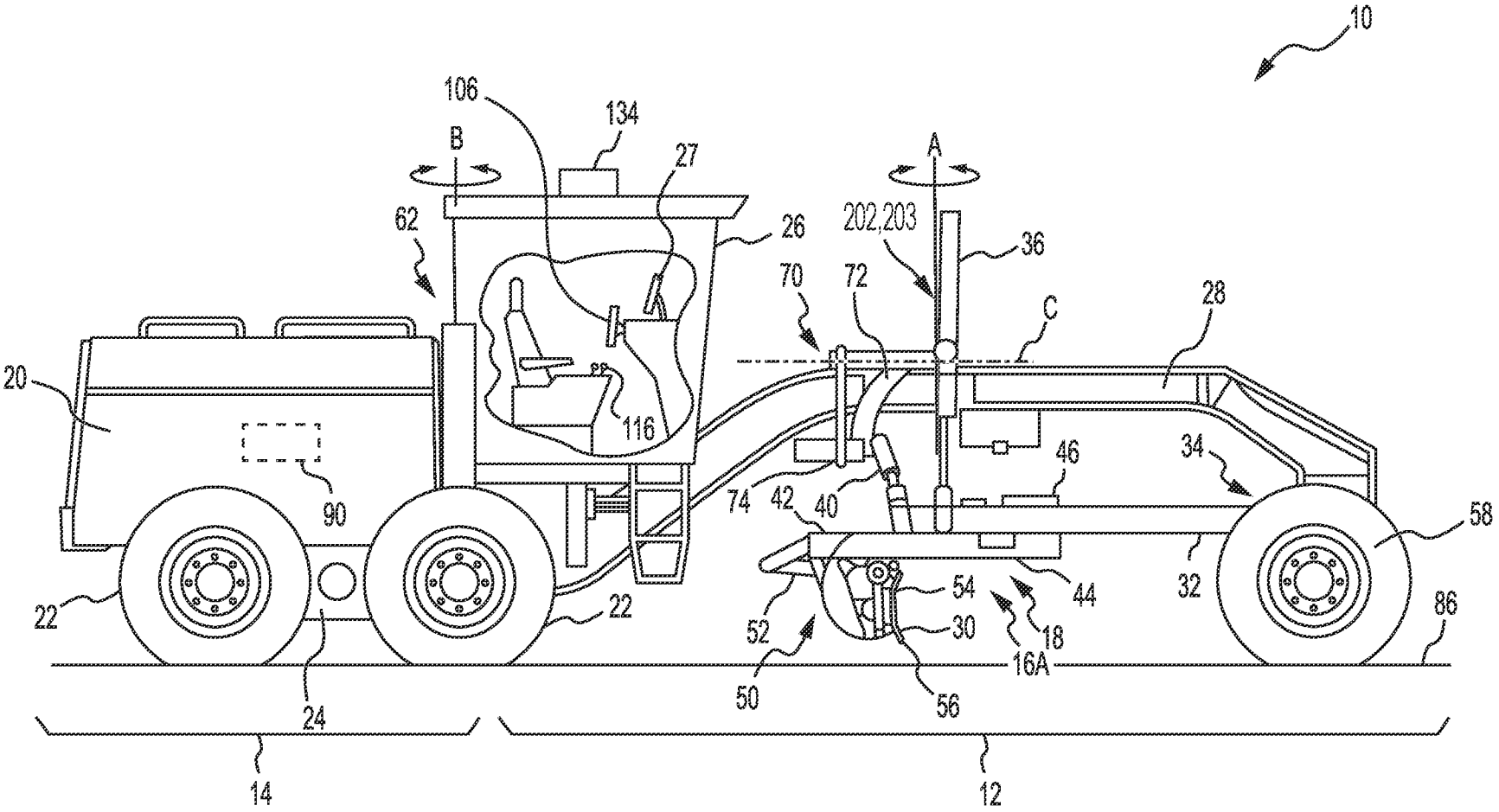
FIG. 1 PRIOR ART
FIG. 1 is a side elevational view of a motor grader within which embodiments of the described system may be implemented according to aspects of this disclosure.

In general, this disclosure relates to motor graders, which are machines used for grading of surfaces, i.e., smoothing an earthen or other particulate surface for construction, road building, and other application that requires the creation of a relatively smooth or flat surface. A motor grader typically includes a plurality of wheels that convey the machine over the ground, as well as one or more large blades beneath the machine for removing surface material.

FIGS. 1-4 are schematic views of a conventional motor grader 10. As shown, motor grader 10 includes a front frame 12, rear frame 14, and at least one work implement, such as main blade assembly 16. Rear frame 14 includes a power source (not visible), which is typically contained within a rear compartment 20. The power source is operatively coupled through a transmission to rear traction devices or wheels 22, 23 for primary machine propulsion (22 indicating the right side the rear traction devices or wheels, and 23 indicating the left side rear traction devices or wheels). The power source may be, for example, a diesel engine, a gasoline engine, a natural gas engine, or any other engine. The power source may also be an electric motor linked to a fuel cell, capacitive storage device, battery, or another source of power. Rear wheels 22, 23 are operatively supported on tandem axles 24, which are pivotally connected to motor grader 10 between rear wheels 22, 23 on each side of motor grader 10. The transmission may be a mechanical transmission, hydraulic transmission, or any other transmission type. The transmission may be operable to produce multiple output speed ratios (or a continuously variable speed ratio) between the power source and driven traction devices.

Figure 2:
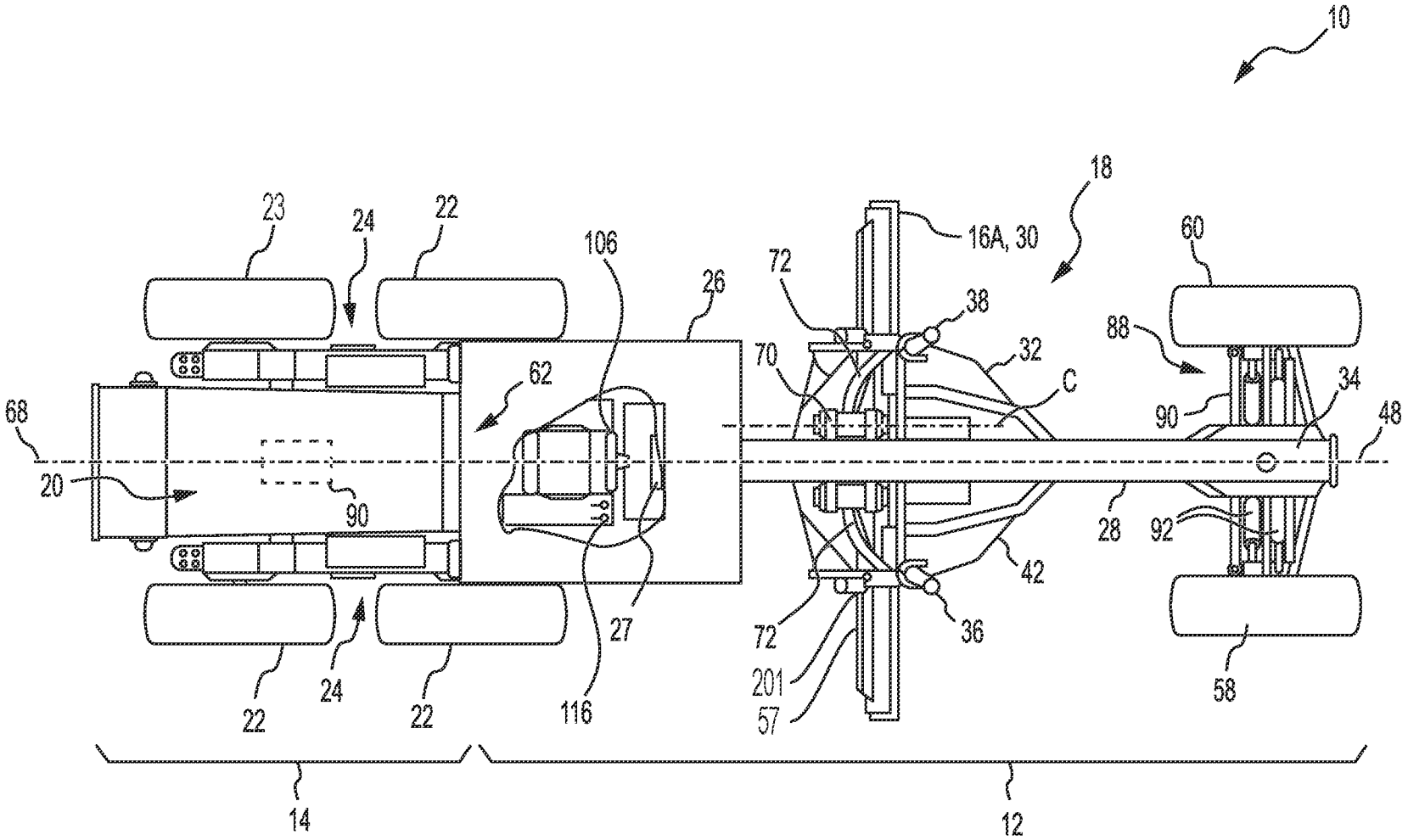
FIG. 2 PRIOR ART
FIG. 2 is a top plan view of the motor grader of FIG. 1.
Figure 3:
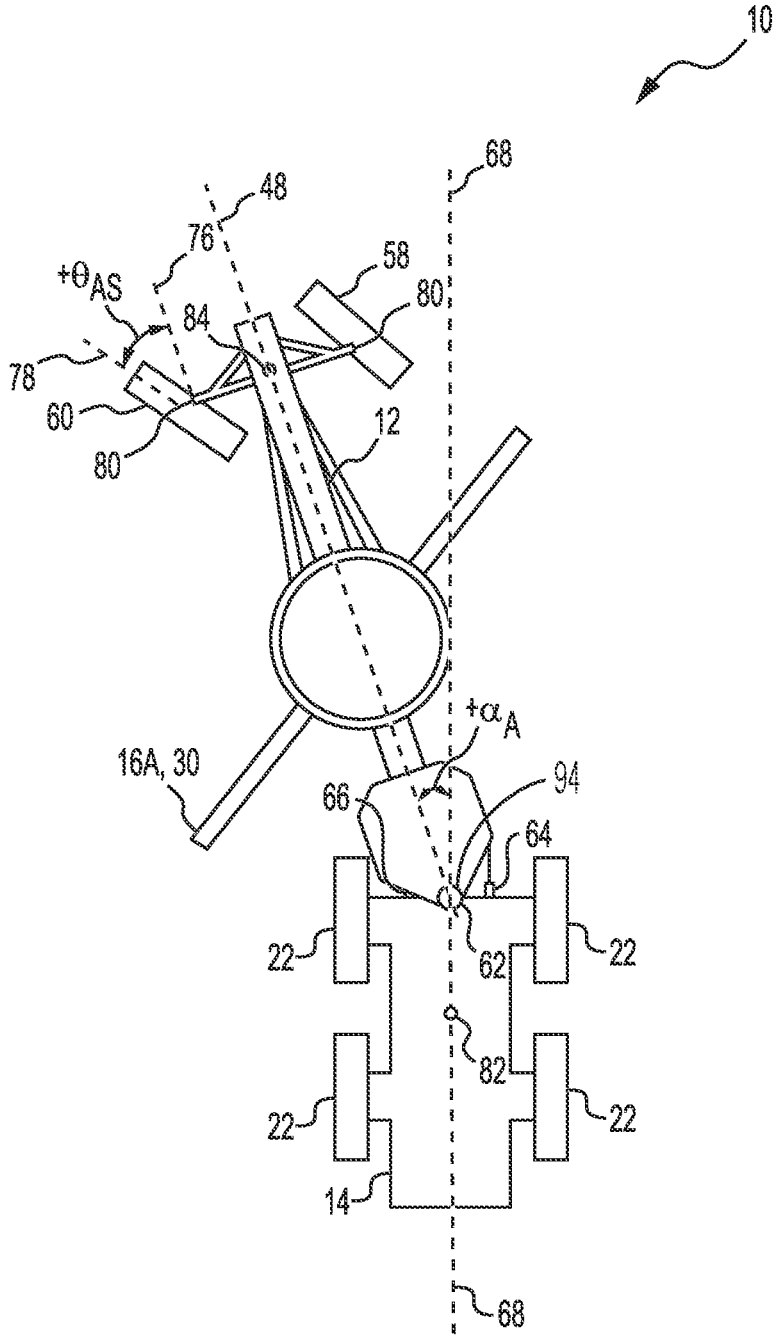
FIG. 3 PRIOR ART
FIG. 3 is a schematic plan view of the motor grader of FIGS. 1 and 2.

Motor grader steering is generally accomplished through a combination of both front wheel steering and machine articulation (i.e., an articulation of front frame 12 with respect to rear frame 14 at articulation joint 62). As shown in FIG. 2, steerable traction devices, such as right and left front wheels 58, 60, are associated with a beam 28 of front frame 12. Front wheels 58, 60 may be both rotatable and tiltable for use during steering and leveling of a work surface 86. Front wheels 58, 60 are connected via a steering apparatus 88 that may include a linkage 90 and a hydraulic cylinder for rotation about front wheel pivot points 80 (e.g., as shown in FIG. 3), and tilt cylinders 92 to control front wheel tilt. The steerable front wheels 58, 60 and/or rear driven traction devices 22, 23 may include tracks, belts, or other traction devices as an alternative to wheels. For the purposes of this disclosure, the term "wheels" will be utilized to include wheels, tracks, belts, or other traction devices. Front wheels 58, 60 may also be driven, as is the case in motor graders provided with all-wheel drive. For example, the power source may be operatively connected to a hydraulic pump (not visible in figures) fluidly coupled to one or more hydraulic motors (not visible in figures) associated with front wheels 58, 60. For the purposes of this disclosure, the terms "wheel" and "wheels" will be utilized to mean "traction device" or "traction devices," respectively, and will include wheels, tracks, belts, or other traction devices.

As shown in FIG. 3, an actual steering angle $\theta_{AS}$ of front wheels 58, 60 is defined between a longitudinal axis 76 parallel to longitudinal axis 48 of front frame 12 and a longitudinal axis 78 of front wheels 58, 60, the actual steering angle $\theta_{AS}$ having an origin at pivot point 80 of front wheels 58, 60. Actual steering angle $\theta_{AS}$ is demonstrated in connection with left front wheel 60, but could be based upon a steering angle for right front wheel 58 or left front wheel 60. Alternatively, a centerline steering angle may be calculated that is an average of right and left steering angles in the event that some variation or error exists based upon, for example, wheel misalignment or sensor errors.

Motor grader 10 also includes an articulation joint 62 that pivotally connects front frame 12 and rear frame 14. Both a right articulation actuator 64 and left articulation actuator 66 are connected between front frame 12 and rear frame 14 on opposing sides of motor grader 10, as shown in FIG. 3. Right and left articulation actuators 64, 66 are used to pivot front frame 12 relative to rear frame 14 about an articulation axis B.

FIG. 3, which is a schematic top view of motor grader 10, shows that front frame 12 rotated at an actual current relative articulation angle $+\alpha_A$ defined by the intersection of longitudinal axis 48 of front frame 12 and longitudinal axis 68 of the rear frame 14, the intersection corresponding with the position of articulation joint 62. In this illustration, a positive actual current relative articulation angle $\alpha_A$ is indicative of a left articulation from the perspective of a motor grader operator facing forward, while a negative actual articulation angle da would be indicative of a right articulation. In FIG. 2, in contrast, motor grader 10 is positioned in the neutral or zero actual current relative articulation angle $\alpha_A$ position, wherein longitudinal axis 48 of front frame 12 is aligned with longitudinal axis 68 of rear frame 14.

Returning to FIGS. 1-2, front frame 12 typically supports an operator station 26 that contains operator controls, along with a variety of displays or indicators, such as user interface 27, for conveying information to the operator for primary operation of motor grader 10 or receiving input from the operator. Operator station 26 may also include one or more steering controls 106 (e.g., for steering front wheels 58, 60 via steering apparatus 88). Steering controls 106 may be, for example, a steering wheel 106 or any other type of operator input device, such as a dial, joystick, keyboard, pedal, or other devices. Operator station 26 also includes one or more articulation controls 116 (e.g., for controlling right and left articulation actuators 64, 66). Articulation controls 116 could also be any type of operator input device, such as a dial, joystick, keyboard, pedal, or other device.

Motor grader 10 may also work in conjunction with a global navigation satellite system, or GNSS. A GNSS is a satellite navigation system with global coverage that can be used to provide autonomous geo-positioning of objects associated with the GNSS, such as an autonomously operated motor grader. One example of a GNSS is a global positioning system, or GPS. The GNSS may include a satellite positioning unit 134 disposed on motor grader 10. Satellite positioning unit 134 generates signals indicative of a location of motor grader 10. Satellite positioning unit 134 may determine and generate signals corresponding to the latitude and/or longitude of motor grader 10. Satellite positioning unit 134 may be disposed on a top portion of motor grader 10 (e.g., on operator station 26, as shown in FIG. 1), to communicate with a number of satellites of the GNSS and to receive signals indicative of a location of motor grader 10, although satellite positioning unit 134 may be disposed elsewhere on motor grader 10.

The front frame 12 includes a longitudinally extending beam 28, which may support one or more work implements, such as the main blade assembly 16. The beam 28 is employed to move blade 30 thereof to a wide range of positions relative to motor grader 10. Main blade assembly 16 is one example of a work implement that can produce a load L on motor grader 10. Other work implements can include front blade assembly (not illustrated), rippers, snow wings, scarifiers, etc.

Main blade assembly 16 includes a drawbar 32 pivotally mounted to a first end 34 of beam 28 via a ball joint or the like. The position of drawbar 32 is typically controlled by hydraulic cylinders including a right lift cylinder 36 and left lift cylinder 38 (FIG. 2) that control vertical movement, and a drawbar sideshift or centershift cylinder 40 (FIG. 1) that controls horizontal movement. Inasmuch as the centershift cylinder 40 likewise controls shifting of the circle 44, the centershift cylinder 40 is sometimes referred to as a circle centershift cylinder or a circle sideshift cylinder. Right and left lift cylinders 36, 38 are connected to a coupling 70 that includes lift arms 72 pivotally connected to beam 28 for rotation about respective yoke axes C. Those of skill in the art will note that yoke axis C in noted in FIG. 2 with regard to the left lift cylinder 38. The right lift cylinder 36 rotates about a similarly situated axis (not labeled) on the opposite side of the beam 28 as illustrated in FIG. 2. A bottom portion of coupling 70 may have an adjustable length horizontal member 74 that is connected to centershift cylinder 40.

Drawbar 32 may include a large, flat plate, commonly referred to as a yoke plate 42. Beneath yoke plate 42 is a circular gear arrangement and mount, commonly referred to as a circle 44. Circle 44 is rotated by, for example, a hydraulic motor referred to as a circle drive 46. Rotation of circle 44 by circle drive 46 rotates attached blade 30 about an axis A perpendicular to a plane of drawbar yoke plate 42.

Blade 30 is also mounted to circle 44 via a pivot assembly 50 that allows for tilting of blade 30 relative to circle 44. A blade tip cylinder 52 is used to tilt blade 30 forward or rearward. In other words, blade tip cylinder 52 is used to tip or tilt a top edge 54 of blade 30 relative to a bottom cutting edge 56 of blade 30, which is commonly referred to as a blade tip. Blade 30 is also mounted to a sliding joint associated with circle 44 that allows blade 30 to slide or shift from side-to-side relative to circle 44. The side-to-side shift is commonly referred to as blade sideshift. One or more sideshift cylinders 57 or the like are used to control the blade sideshift.

The foregoing components allow for movement of blade 30 in a number of different manners. To determine a position of blade 30, as well as other elements of the motor grader 10, the motor grader 10 can include a number of sensors. For example, the motor grader 10 may be provided with a mainfall or body inertial measurement unit (IMU) sensor 136. As used herein, an IMU may refer to any electronic device capable of detecting acceleration, angular rate, and/or angular position. For example, an IMU may include one or more accelerometers and/or one or more gyroscopes, among other possibilities. As used here, an angle sensor may refer to any electronic device capable of detecting angular rate and/or angular position. As such, an IMU as described herein may include an angle sensor and/or an acceleration sensor. In some embodiments, an angle sensor may directly detect angular rate and may integrate to obtain angular position, or alternatively an angle sensor may directly measure angular position and may determine a change in angular position (e.g., determine the derivative) to obtain angular rate. In many instances, an angle sensor is used to determine the yaw angle (rotation angle with respect to a vertical axis), the pitch angle (rotation angle with respect to a transverse axis), and/or the roll angle (rotation angle with respect to a longitudinal axis). Further, for the purposes of this disclosure, an IMU includes at least one sensor.

In some embodiments, a body IMU 136 (or, more specifically, a body angle sensor) may be mounted to front frame 12 (see FIG. 4) so as to detect angular movement of front frame 12. In some embodiments, body IMU 136 may be configured to detect a yaw angle, a pitch angle, and/or a roll angle associated with angular movement of front frame 12. Alternatively or additionally, body IMU 136 may be mounted to any component that is rigidly connected to front frame 12 (e.g., left and right lift arms 72) such that body IMU 136 may detect angular movement of the body of motor grader 10. In this way, the articulation sensor 94 or a body IMU 136 may be provided to measure articulation between the front and rear frames 12, 14.

Figure 4:
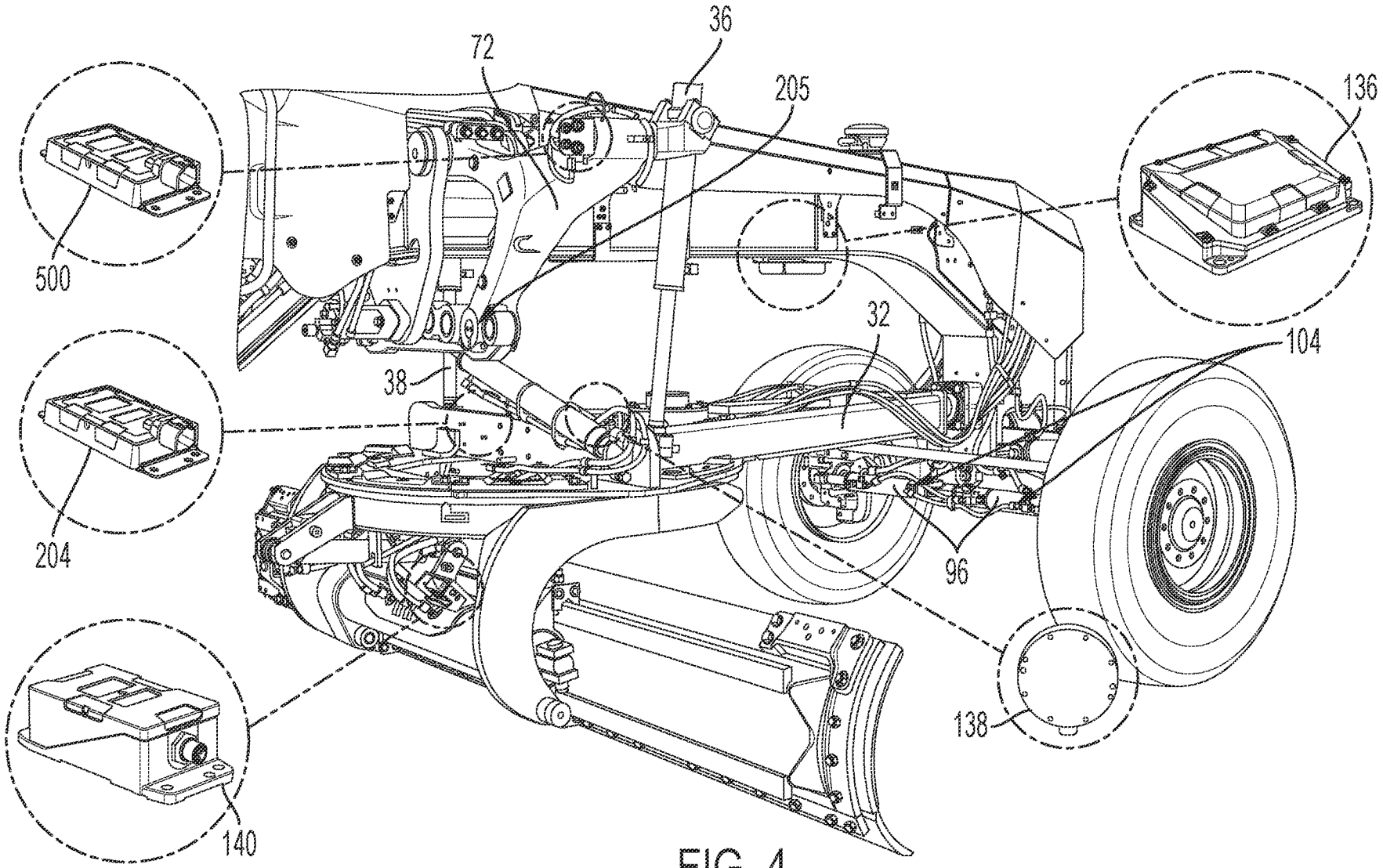
FIG. 4 PRIOR ART
FIG. 4 is an enlarged, detailed, partially exploded, isometric view showing an exemplary work implement and its coupling to the motor grader of FIGS. 1-3.

By way of further example of such sensors, one or more rotation sensors 138, and blade slope and/or blade pitch sensors 140, as shown in FIG. 4, may be provided. These sensors may be used, for example, to measure the circle rotation angle of circle 44, and the blade slope or pitch of blade 30, respectively. In at least one embodiment, a combination of signals from a yoke sensor (IMU) 500 and drawbar sensor (IMU) 204 may be utilized to calculate the right and left blade lift. Additional sensors may include one or more of positioning sensors, such as right and left blade lift sensors configured to provide a signal indicative of the relative position of the right and left portions of the blade 30 resulting from operation of the a right and left lift cylinders 36, 38, respectively, blade sideshift sensor configured to provide a signal indicative of a side shifted position of the blade 30 relative to a central position, and drawbar sensor (IMU) configured to provide a signal indicative of position from which the drawbar 32 and supported blade have shifted left or right relative to a central position.

The sensors identified herein may be of any appropriate type, such as, for example, rotary sensors, cylinder linear position sensors, or inertial measurement units ("IMU"), or combinations thereof. IMUs are self-contained sensor systems capable of generating signals indicative of linear and angular motion. A multi-axis IMU includes two or more gyroscopes and accelerometers for measuring linear and angular motion in at least two dimensions (e.g., along two axes).

Mainfall sensor 136 may be a single multi-axis inertial measurement unit ("IMU") configured to produce a signal indicative of the longitudinal pitch of motor grader 10 and a signal indicative of the lateral roll of motor grader 10. The axes of the illustrated multi-axis IMU are typically aligned with the longitudinal axis of motor grader 10 (e.g., longitudinal axis 48 of front frame 12) and the lateral axis of motor grader 10 to generate signals indicative of the longitudinal pitch and lateral roll of motor grader 10, respectively.

Rotation or circle rotation sensor 138 may be configured to produce a signal indicative of the angle of blade 30 relative to front frame 12 and the lateral axis of motor grader 10. Rotation sensor 138 produces a signal indicative of the direction of blade 30 relative to the direction of travel of motor grader 10.

Blade slope sensor 140 may be configured to produce a signal indicative of slope of blade 30 laterally, or blade slope. The axis of body IMU 136 is aligned with the longitudinal axis of motor grader 10 (e.g., longitudinal axis 48 of front frame 12) to generate signals indicative of the longitudinal pitch of motor grader 10, while blade slope sensor 140 generates signals indicative of the lateral roll of motor grader 10 when blade 30 is aligned with a lateral axis of motor grader 10.

Rotation sensor 138 can be used in conjunction with blade slope sensor 140 to determine the lateral roll of motor grader 10 when blade 30 is aligned with the lateral axis of motor grader 10, ensuring the signals from blade slope sensor 140 are measuring the slope of a surface that is perpendicular to the direction of travel of motor grader 10.

Figure 8:
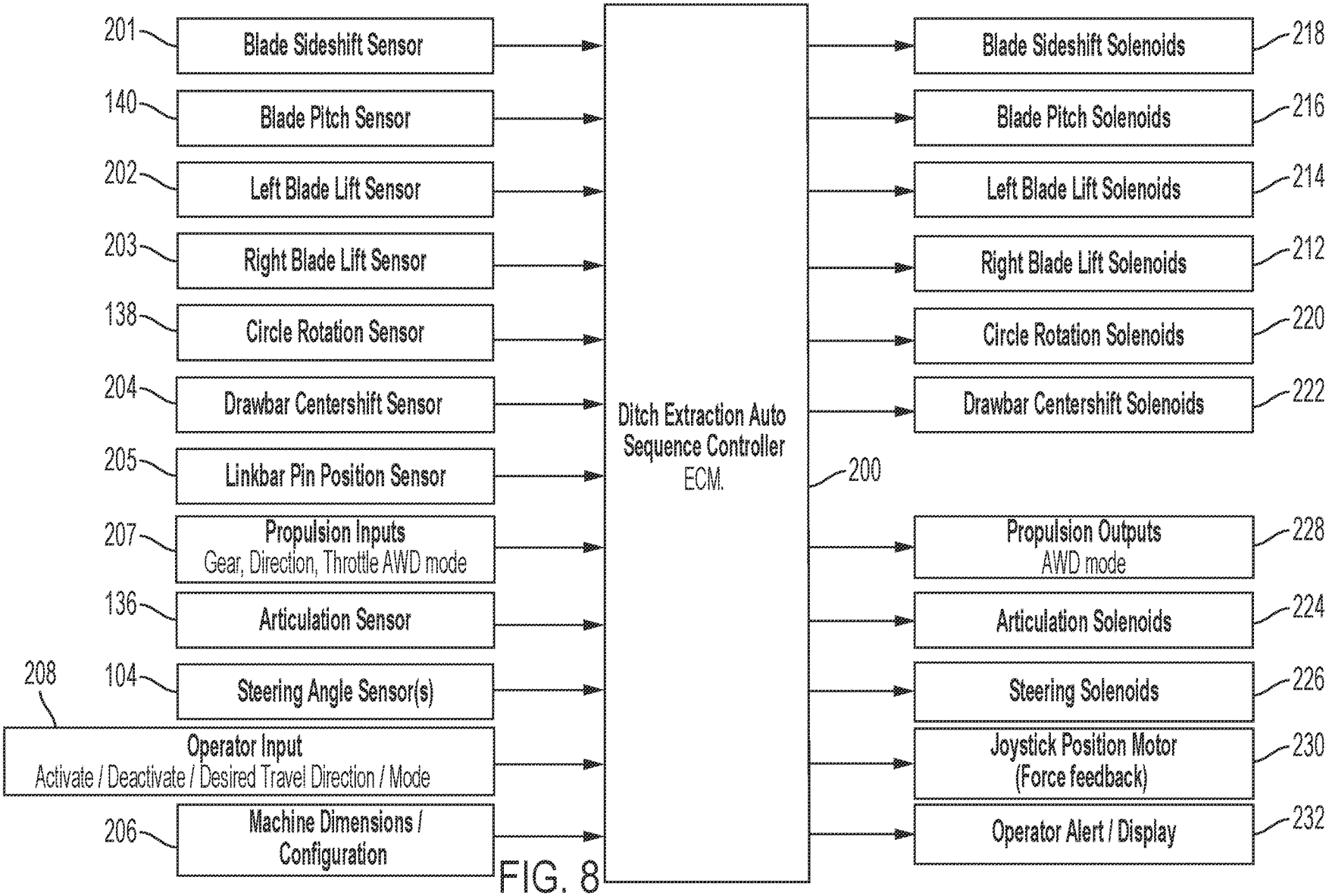
FIG. 8 is a flow chart showing exemplary inputs to a ditch extraction auto sequence controller and exemplary outputs the ditch extraction auto sequence controller according to aspects of this disclosure.

In accordance with aspects of this disclosure, there is provided a system and method for extracting a motor grader 10 from a first position wherein wheel slippage occurs, that is, where one or more of the wheels 22, 23, 58, 60 has lost traction such that it slips relative to a work surface 86 and inhibits accurate operation of the motor grader 10, to a second position of comparatively greater traction. Referring to FIG. 8, a ditch extraction auto sequence controller 200 is provided. The ditch extraction auto sequence controller 200 may be configured, for example, via a control algorithm, to receive a plurality of signals from various sensors and/or operator commands, and to responsively control various machine actuators and/or communicate with the machine operator. The ditch extraction auto sequence controller 200 may include various components for executing software instructions designed to regulate subsystems of motor grader 10. For example, the ditch extraction auto sequence controller 200 may include a central processing unit (CPU), a random access memory (RAM), a read-only memory (ROM), input/output elements, etc. Controller 200 may execute machine-readable instructions stored in controller 200 on a mass storage device, RAM, ROM, local memory, and/or on a removable storage medium, such as a CD, DVD, and/or flash memory device.

Referring to FIG. 8, a plurality of inputs indicative of aspects of the motor grader 10 or commands from an operator may be provided to the ditch extraction auto sequence controller 200 from which the ditch extraction auto sequence controller 200 produces a series of signals to operate various aspects of the motor grader 10. In this way, the ditch extraction auto sequence controller 200 may automatically produce a sequence of operations to place the motor grader on a second position wherein wheel slippage no longer occurs or wherein the wheels are provided with sufficient traction to operate the motor grader 10.

The inputs provided to the ditch extraction auto sequence controller 200 may include inputs indicative of the position of the blade 30. Such inputs may include, for example, one or more of sensor data or signals from one or more articulation sensors 94, machine pitch sensors, or body IMU 136, a blade IMU or one or more blade slope and/or pitch sensors 140, one or more left and right blade lift sensors 202, 203, one or more blade sideshift sensors 201, and one or more circle rotation sensors 138, linkbar pin position 205, and one or more drawbar centershift sensors 204. It will be appreciated that one or more of these sensors may be utilized, alone or in combination to calculate various positions of machine structures. In at least one embodiment, for example, the blade 30 position may be determined based upon sensor data from one or more circle rotation sensors 138, a blade slope/pitch IMU 140, one or more blade sideshift sensors 201, and a drawbar centershift sensor 204 and yoke IMU 500, the drawbar centershift sensor 204 and yoke IMU 500 being utilized to calculate blade lift. By way of further example, alternatively or additionally, in at least one embodiment, one or more blade lift cylinder sensors 202, 203 may be utilized to directly measure blade lift, as opposed to calculating blade lift based upon a drawbar centershift sensor 204 and a yoke IMU 500.

Inputs provided to the ditch extraction auto sequence controller 200 may additionally include inputs indicative of the positions of the front and rear frames 12, 14, as well as the steering angle of the motor grader 10. For example, motor grader 10 may include one or more steering angle sensors 104 associated with one or both of right and left front wheels 58, 60 and/or steering apparatus 88 to provide actual steering angle $\theta_{AS}$ to ditch extraction auto sequence controller 200 (see FIG. 4). Steering angle sensors 104 can monitor angles of rotation of steering linkages 90 and/or pivot points 80 at front wheels 58, 60. Steering angle sensors 104 can alternatively measure an extension amount of an actuator, such as a hydraulic actuator, that controls the steering of front wheels 58, 60. In this manner, steering angle sensors 104 may provide data "indicative of" actual steering angle $\theta_{AS}$, including direct measurements of the quantity or characteristic of interest, as well as indirect measurements, such as a different quantity or characteristic having known relationships with the quantity or characteristic of interest. Steering angle sensors 104 could be any type of sensor, including, for example, potentiometers, extension sensors, proximity sensors, angle sensors, and the like. The ditch extraction auto sequence controller 200 may also receive a signal from one or more steering controls 106 indicative of a desired steering angle $\theta_{DS}$ of motor grader 10. Steering controls 106 may be, for example, steering wheel 106 shown in FIGS. 1-2.

In addition to the variable inputs measured by various sensors, inputs indicative of other aspects of the motor grader 10 may be provided to the ditch extraction auto sequence controller 200. For example, one or more signals indicative of aspects of the motor grader 10 such as machine configuration parameters 206 may be provided to the ditch extraction auto sequence controller 200. The machine configuration parameters may include, for example, information specific to the machine, such as the type and size of the machine, the particular dimensions of the machine and one or more of its individual components, such as the frame, articulation joint location, tire size, wheel base, blade length, and the fore/aft positioning of the blade relative to the machine, etc. The dimensions may include, by way of example only, the length of the blade 30, front frame 12, or drawbar 32, distance between the first end 34 of beam 28 and the blade 30, center shift cylinder 40, or right and left lift cylinders 36, 38.

Additionally, one or more signals indicative of propulsion inputs 207, such as gear direction and throttle all-wheel drive, may be provided to the ditch extraction auto sequence controller 200. Further, in order to initiate or end the ditch extraction auto sequence, operator input 208 such as activation, deactivation, and desired travel direction. In at least some embodiments, the operator input 208 may include a particular mode based upon the degree or location of the slippage in the first position.

Referring again to FIG. 8, the ditch extraction auto sequence controller 200 may then produce a plurality of signals to initiate a desired sequence of operations of varied aspects of the motor grader 10, including one or more of a current relative articulation angle of the front and rear frames 12, 14 based upon a difference between the current relative articulation angle and a desired relative articulation angle, a current steering angle $\theta_{AS}$ of the front wheels 58, 60 based upon a difference between the current steering angle and a desired steering angle, a position and disposition of the blade 30 based upon the current and the desired position and disposition, propulsion of one or more of the wheels 22, 23, 58, 60, and direction of propulsion to provide an automatic execution of the extraction procedure. For example, in order to provide a desired position and disposition of the blade 30, the ditch extraction auto sequence controller 200 may provide one or more signals to one or more right and left blade lift solenoids 212, 214 in order to control the right and left lift cylinders 36, 38, blade pitch solenoids 216 to control the blade tip cylinder 52, blade sideshift solenoids 218 to control the blade sideshift cylinder 57, circle rotation solenoids 220 to control the circle drive 46 and rotation of the circle 44, and drawbar centershift solenoids 222 to control the centershift cylinder 40 in order to initiate corresponding movement in the associated component or components.

In order to further direct positioning and/or movement of the motor grader 10, the ditch extraction auto sequence controller 200 may further provide one or more signals to one or more articulation solenoids 224 in order control the left and right articulation actuators 64, 66 to modify the relative positions of the front and rear frames 12, 14 if the current relative articulation angle of the front and rear frames 12, 14 differ from a desired articulation angle. Further, the ditch extraction auto sequence controller 200 may further provide one or more signals to one or more steering solenoids 226 in order to modify the steering direction of the front wheels 58, 60. The ditch extraction auto sequence controller 200 may further provide one or more signals relative to desired propulsion outputs 228.

The ditch extraction auto sequence controller 200 may additionally provide signals indicative of operation of the motor grader 10, such force feedback 230 based upon, for example a joystick position motor, to a display 27. The ditch extraction auto sequence controller 200 may additionally provide signals to operate the display 27 and/or to provide alerts 232 to the operator.

Figure 9:
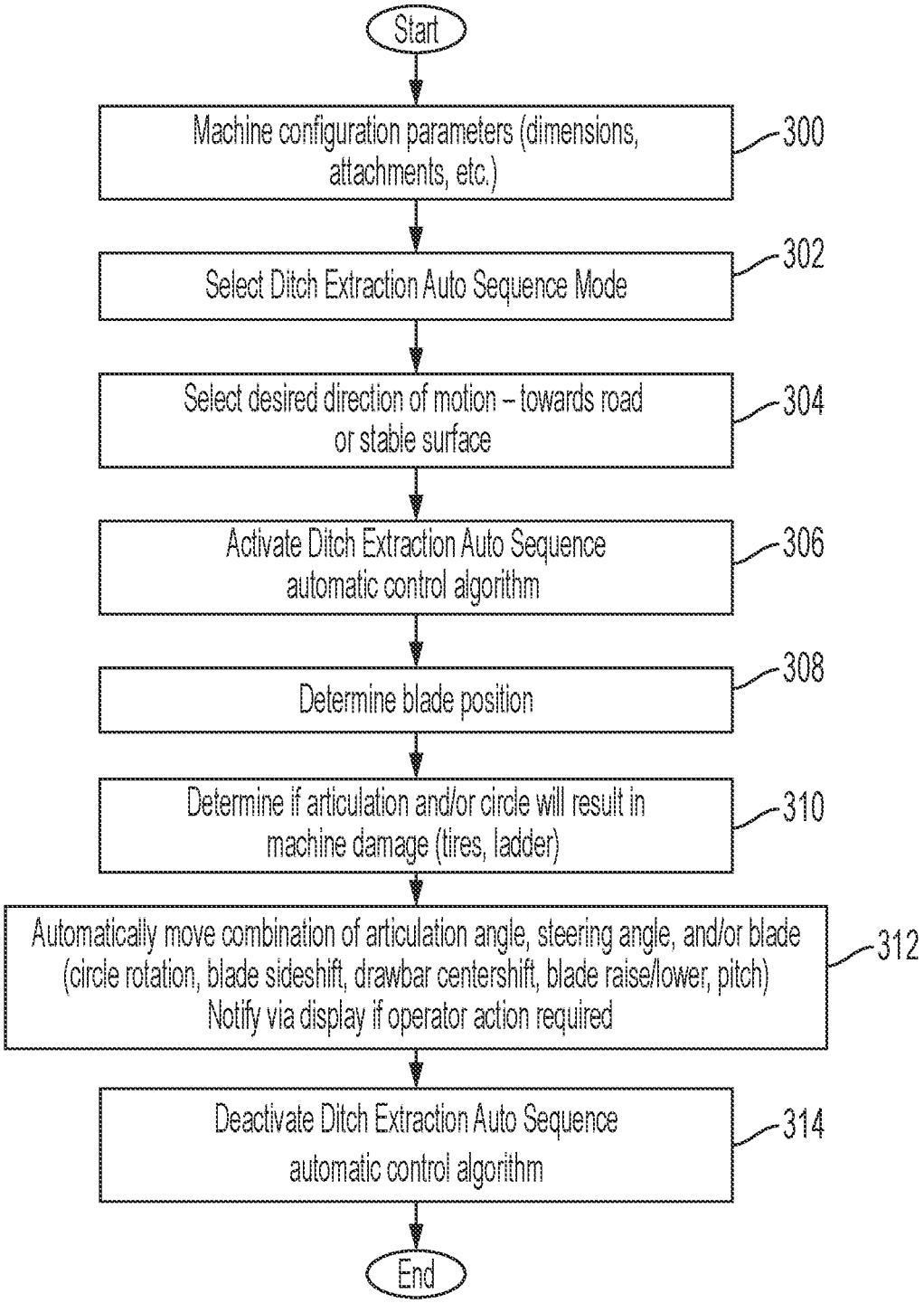
FIG. 9 is flow chart illustrating an exemplary process flow for limiting wheel spin during grading in accordance with the described principles of this disclosure.

Turning to FIG. 9, there is illustrated an exemplary process for extracting a motor grader 10 from a first position wherein wheel slippage occurs during grading of a surface underlying the motor grader 10. Machine configuration parameters are provided (step 300), including, for example, motor grader dimensions, attachments, etc. (see 206). The operator selects a ditch extraction auto sequence mode (step 302), and a desired direction of motion in order to direct the motor grader 10 to a second more stable surface (step 304) (see 208). The operator then activates the ditch extraction auto sequence automatic control algorithm (step 306). From the various inputs provided to the ditch extraction auto sequence controller 200 illustrated in FIG. 8, for example, the ditch extraction auto sequence controller 200 determines the position of the blade 30 (step 308). The ditch extraction auto sequence controller 200 then determines whether articulation of the blade 30, either directly or by articulation of the circle 44, would result in damage to the motor grader 10 (step 310). For example, the ditch extraction auto sequence controller 200 determines if articulation would result in damage to the wheels 22, 23, 58, 60, or the ladder 25.

Provided no such damage would occur, the ditch extraction auto sequence controller 200 provides a combination of movements or changes to one or more of the relative articulation angle, the steering angle, the blade position and disposition, and machine propulsion and direction (step 312). Changes to the blade 30 position may include, for example, one or more of rotation of the circle 44, sideshifting of the blade 30, shifting of the drawbar 32, raising or lowering the blade 30, and modifying the pitch of the blade 30. In at least one embodiment, if additional action is required by the operator, a notification is provided at the display 27, for example. Following completion of the ditch extraction auto sequence, the ditch extraction auto sequence automatic control algorithm is deactivated (step 314).

INDUSTRIAL APPLICABILITY

According to another aspect of this disclosure, a ditch extraction auto sequence directed by the ditch extraction auto sequence controller 200 may be tailored to the particular environment or the degree to which the motor grader 10 has lost traction. That is, the ditch extraction auto sequence controller 200 may execute an extraction sequence in a number of modes. In this way, a plurality of ditch extraction auto sequences may be provided such that an appropriate auto ditch extraction auto sequence may be identified for a given situation. Those of skill in the art will appreciate that if the motor grader 10 has all-wheel-drive, it may be activated to provide better traction in one or more of the modes.

Figure 5:
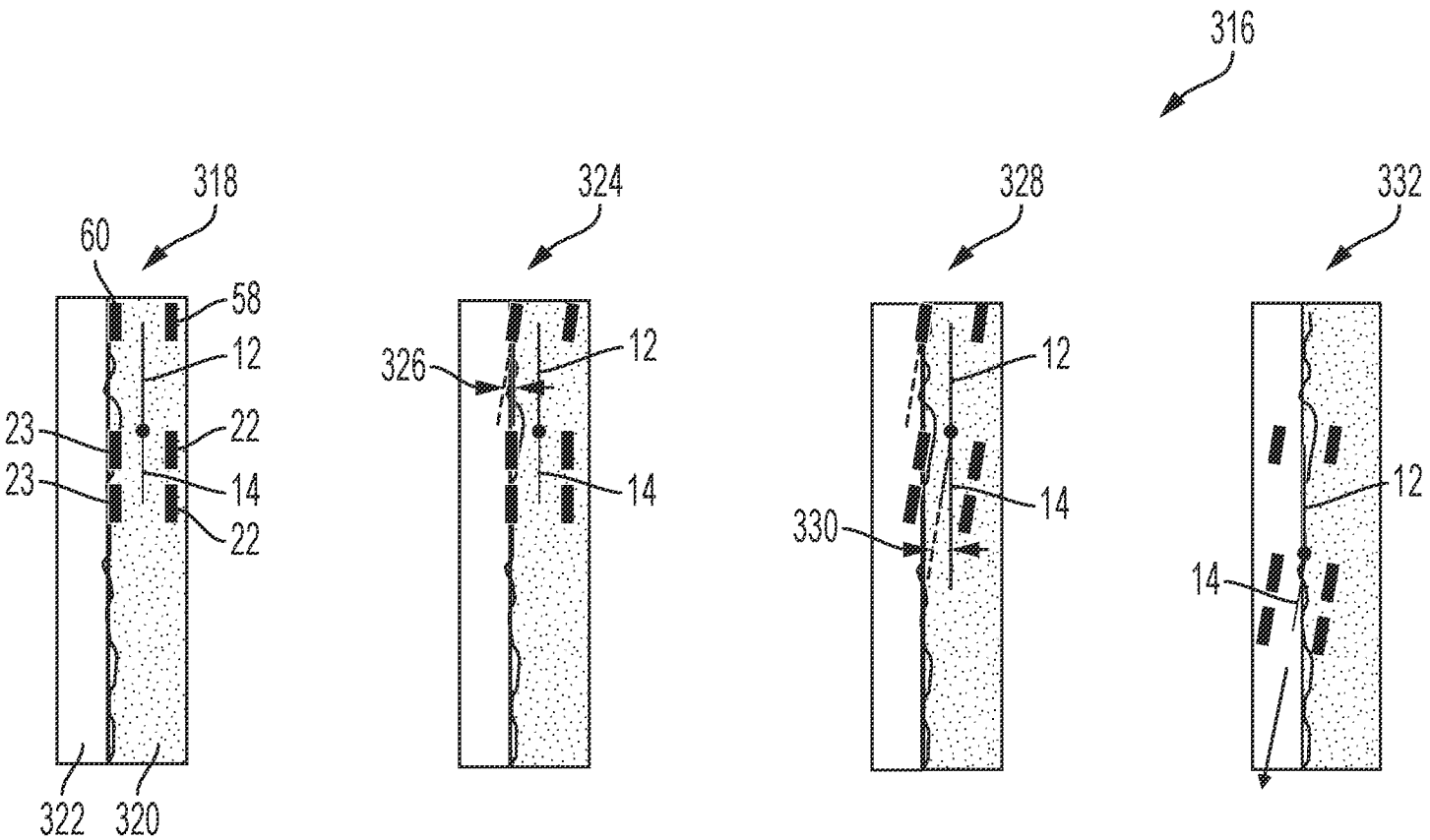
FIG. 5 is a schematic illustrating a relative positions of components of a motor grader during an exemplary first ditch extraction auto sequence mode according to aspects of this disclosure.
Figure 6:
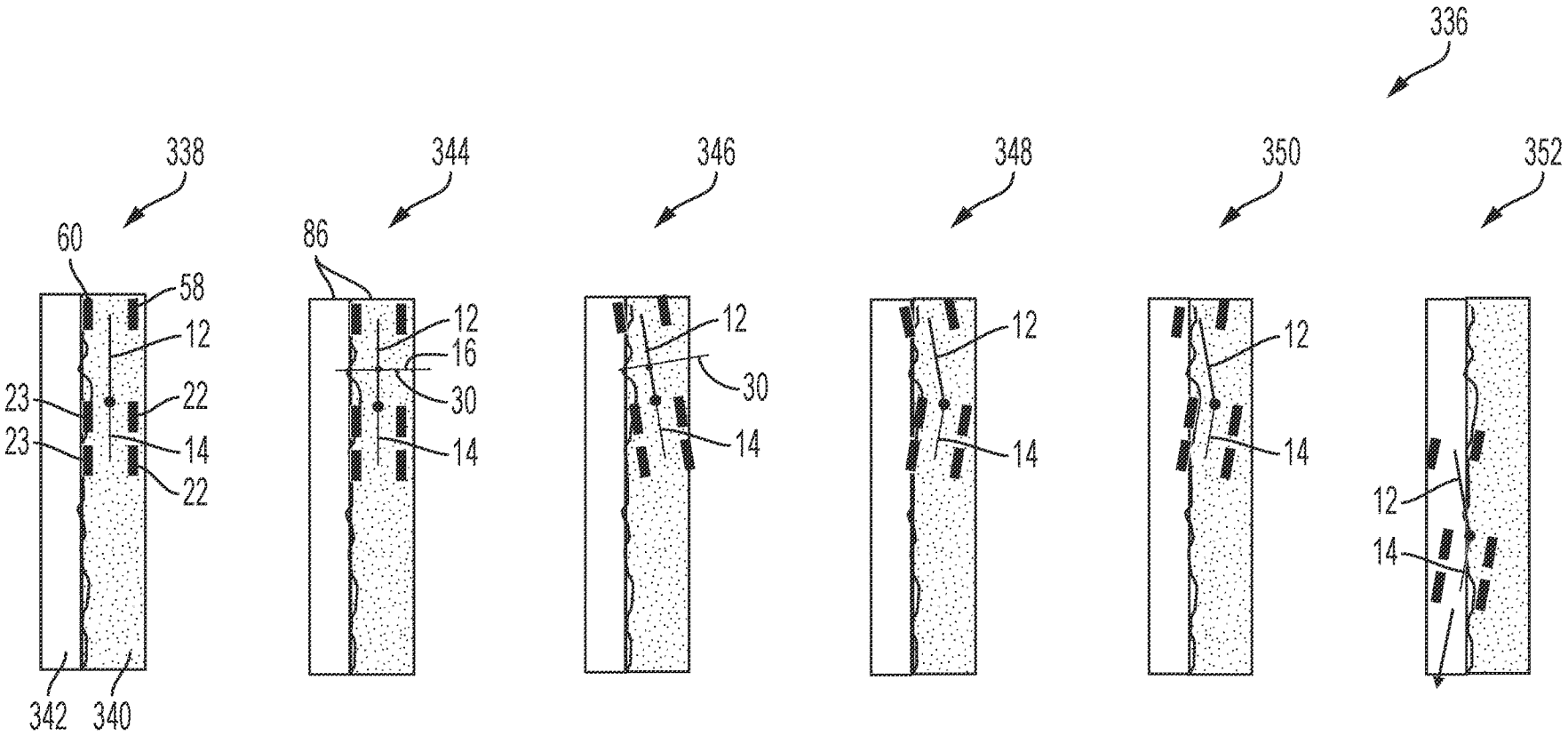
FIG. 6 is a schematic illustrating a relative positions of components of a motor grader during an exemplary second ditch extraction auto sequence mode according to aspects of this disclosure.
Figure 7:
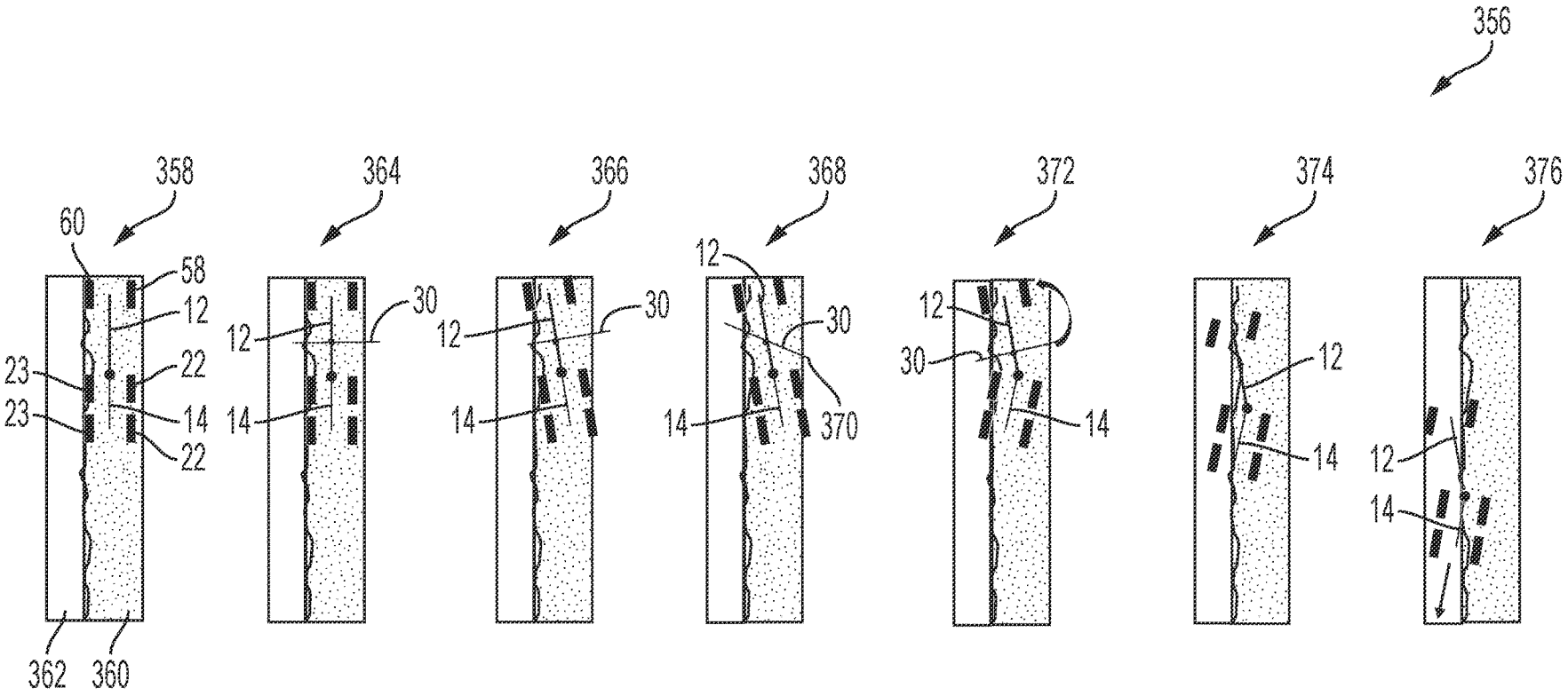
FIG. 7 is a schematic illustrating a relative positions of components of a motor grader during an exemplary third ditch extraction auto sequence mode according to aspects of this disclosure.

Exemplary ditch extraction auto sequences are illustrated in FIGS. 5-7, and are explained with references to the schematics of FIGS. 5-7, as well as the flow charts of FIGS. 8-9. While the exemplary ditch extraction auto sequences are illustrated in FIGS. 5-7 with respect to particular positions of the motor grader 10 relative to locations of reduced traction and greater traction, the disclosed methods may be applicable to a motor grader 10 alternatively positioned. By way of example only, the area of reduced traction could be a ditch or a muddy area, while the area of comparatively greater traction could be a road or a graded area. By way of further example, in the illustration of FIGS. 5-7, all of the wheels 22, 23, 58, 60 are disposed in the area of reduced traction, the wheels 23, 60 along the left side being disposed substantially adjacent the area of comparatively greater traction. Those of skill in the art will appreciate that the motor grader 10 may be alternatively disposed. For example, the area of comparatively greater traction may be disposed to the right of the motor grader 10, or one or more of the wheels 22, 23, 58, 60 may be disposed in the area of comparatively greater traction, or a gradual transition may exist between the area of reduced traction and the area of comparatively greater traction. Those of skill in the art will appreciate that the exemplary ditch extraction auto sequences may likewise be effective to relocate the motor grader 10 under alternative physical conditions and locations, however.

A first exemplary ditch extraction auto sequence mode 316 is illustrated in a series of schematic illustrations in FIG. 5. The first exemplary ditch extraction auto sequence mode 316 utilizes a combination of movements of the blade 30, articulation of the relative positions of the front and rear frames 12, 14, steering of the front wheels 58, 60, and propulsion. As shown at 318, the motor grader 10 is positioned in an area of reduced traction 320 substantially adjacent an area of comparatively greater traction 322. The motor grader 10 having reduced traction or being stuck in the ditch, the operator activates the ditch extraction auto sequence 306 to initiate a plurality of determinations and actions 306, 308, 310, 312. In order to improve blade clearance, the blade 30 is raised and pitched back by, for example, the ditch extraction auto sequence controller 200 providing appropriate signals to the blade pitch solenoids 216, and the right and left blade lift solenoids 212, 214.

Referring to 324, the front wheels 58, 60 are turned toward the area of reduced traction 320 by the ditch extraction auto sequence controller 200 providing one or more signals to the steering solenoids 226. For example, the front wheels 58, 60 may be turned and angle 326 on the order of 15° toward the area of reduced traction 320, although alternative degrees of steering are envisioned.

Referring to 328, the ditch extraction auto sequence controller 200 provides one or more signals to articulate the rear frame 14 towards the area of comparatively greater traction 322. In this way, the ditch extraction auto sequence controller 200 may provide one or more signals to the articulation solenoids 224. In at least one embodiment, the rear frame 14 is articulated to an angle 330 that matches the angle 326 that the front wheels 58, 60 have been turned.

Referring to 332, the ditch extraction auto sequence controller 200 provides one or more signals to place the motor grader 10 in reverse and apply propulsion 228. The motor grader may then be crab walked out of the area of reduced traction 320. Those of skill in the art will appreciate that the ditch extraction auto sequence illustrated in FIG. 5 is particularly useful in dry conditions.

A second exemplary ditch extraction auto sequence mode 336 is illustrated in a series of schematic illustrations in FIG. 6. The second exemplary ditch extraction auto sequence mode 336 utilizes a combination of movements of the blade 30, articulation of the relative positions of the front and rear frames 12, 14, steering of the front wheels 58, 60, and propulsion. As shown at 338, the motor grader 10 is positioned in an area of reduced traction 340 substantially adjacent an area of comparatively greater traction 342. The motor grader 10 having reduced traction or being stuck in the ditch, the operator activates the ditch extraction auto sequence 306 to initiate a plurality of determinations and actions 306, 308, 310, 312.

Referring to 344, the blade 30 is squared relative to the frame 12, 14 by the ditch extraction auto sequence controller 200 providing one or more signals to the circle rotation solenoids 220. The blade 30 is pitched back by the ditch extraction auto sequence controller 200 further provides one or more signals to the blade pitch solenoids 216. The ditch extraction auto sequence controller 200 provides one or more signals to the right and left blade solenoids 212, 214 to lower the blade 30 to the work surface 86; continued lowering then lifts the front wheels 58, 60 from the work surface 86. Referring to 346, the ditch extraction auto sequence controller 200 provides one or more signals to the drawbar or blade sideshift solenoids 218 to move the raised front wheels 58, 60 towards the area of comparatively greater traction 342.

Referring to 348, the ditch extraction auto sequence controller 200 provides one or more signals to the right and left blade lift solenoids 212, 214, and the blade pitch solenoids 216 to raise the blade 30 and pitch the blade 30 back in order to improve clearance of the blade 30. The ditch extraction auto sequence controller 200 then further provides one or more signals to the articulation solenoids 224 to articulate the rear frame 14 with the rear wheels 22, 23 toward the areas of comparatively greater traction 342. As shown in 348, this may place one or more of the left side rear wheels 23 on the area of comparatively greater traction 342.

Referring to 350, the ditch extraction auto sequence controller 200 provides one or more signals to the steering solenoids 226 to turn the front wheels 58 60 towards the area of reduced traction 340. The ditch extraction auto sequence controller 200 provides one or more signals to the propulsion outputs 228 to place the motor grader 10 in reverse and then back the motor grader 10 rearward and towards the area of comparatively greater traction 342.

A third exemplary ditch extraction auto sequence mode 356 is illustrated in a series of schematic illustrations in FIG. 7. The third exemplary ditch extraction auto sequence mode 356 likewise utilizes a combination of movements of the blade 30, articulation of the relative positions of the front and rear frames 12, 14, steering of the front wheels 58, 60, and propulsion. As shown at 358, the motor grader 10 is positioned in an area of reduced traction 360 substantially adjacent an area of comparatively greater traction 362. The motor grader 10 having reduced traction or being stuck in the ditch, the operator activates the ditch extraction auto sequence 306 to initiate a plurality of determinations and actions 306, 308, 310, 312.

Referring to 364, the blade 30 is squared relative to the front frame 12 by the ditch extraction auto sequence controller 200 providing one or more signals to the circle rotation solenoids 220. The blade 30 is pitched back by the ditch extraction auto sequence controller 200 further provides one or more signals to the blade pitch solenoids 216. The ditch extraction auto sequence controller 200 provides one or more signals to the right and left blade solenoids 212, 214 to lower the blade 30 to the work surface 86; continued lowering then lifts the front wheels 58, 60 from the work surface 86.

Referring to 366, with the blade 30 lowered, the ditch extraction auto sequence controller 200 provides one or more signals to the blade sideshift solenoids 218 and/or the centershift cylinder 40 to move the raised front wheels 58, 60 towards the area of comparatively greater traction 362.

Referring to 368, the ditch extraction auto sequence controller 200 provides one or more signals to the right and left blade lift solenoids 212, 214 to raise the blade 30. The ditch extraction auto sequence controller 200 then further provides one or more signals to the circle rotation solenoids 220 to rotate the blade 30 such that the heel 370 or end of the blade 30 toward the area of reduced traction 360 is pivoted towards the rear frame 14. The ditch extraction auto sequence controller 200 then provides one or more signals to the right and/or left blade lift solenoids 212, 214 to lower the blade 30 into the area of reduced traction 360.

Referring to 372, the ditch extraction auto sequence controller 200 provides one or more signals to the circle rotation solenoids 220 to rotate the heel 370 forward, and articulation solenoids 224 to articulate the rear frame 14 towards the area of comparatively greater traction 362. Those of skill in the art will appreciate that this motion will generally partially push at least a portion of the motor grader 10 off the area of reduced traction 360 and onto the area of comparatively greater traction 362.

Referring to 374, in order to improve blade clearance, the blade 30 is raised and pitched back by, for example, the ditch extraction auto sequence controller 200 providing appropriate signals to the blade pitch solenoids 216, and the right and left blade lift solenoids 212, 214. The ditch extraction auto sequence controller 200 provides one or more signals to the steering solenoids 226 to turn the front wheels 58, 60 towards the area of reduced traction 360. In at least one embodiment, the front wheels 58, 60 are turned to an angle matching the current relative articulation angle.

Referring to 376, the ditch extraction auto sequence controller 200 provides one or more signals to the propulsion outputs 228 to place the motor grader 10 in reverse and then back the motor grader 10 rearward and towards the area of comparatively greater traction 362.

Those of skill in the art will thus appreciate that the system and method of this disclosure provides a versatile arrangement for extracting a motor grader 10 from a ditch or area of reduced traction. The arrangement may utilize a plurality of actions to automatically move the motor grader 10 to an area of comparatively greater traction. The ditch extraction auto sequence controller 200 may provide a series of commands tailored to the particular degree to which the motor grader 10 is disabled, providing one or more signals to different systems and components of the machine to move the motor grader 10 from the area of reduced traction. By way of example only, one or more of the exemplary extraction sequences may be utilized to extract a motor grader 10.

The described principles are applicable to machines that are used for grading applications and which include a ground-engaging mechanism, e.g., wheels, tracks, etc. A primary example of such a machine is a motor grader. Within such applications, the described principles may provide a sequence of actions that may be automatically occur once authorized by an operator in order to move a machine from a location of reduced traction to an area of comparatively enhanced traction.

While the method has been described with regard to exemplary ditch extraction auto sequences, those of skill in the art will be appreciated that alternative ordering and combinations of steps may be utilized. Thus, although it will be appreciated that the foregoing description provides useful examples of the disclosed system and technique, it should be appreciated that other implementations of the disclosed principles will differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for the features of interest, but not to exclude such from the scope of the disclosure entirely unless otherwise specifically indicated.

Recitation of ranges of values herein are merely intended to serve as a shorthand method of referring individually to each separate value falling within the range, unless otherwise indicated herein, and each separate value is incorporated into the specification as if it were individually recited herein.

We claim:

1. A system for extracting a motor grader from a first location with reduced traction, where wheel slippage occurs during grading of a surface underlying the motor grader, to a second location of comparatively greater traction, the system comprising:

the motor grader having:

a frame including a front frame and a rear frame, the front and rear frames being articulated relative to one another, a plurality of front wheels supporting the front frame and a plurality of rear wheels supporting the rear frame, one or more of the plurality of front wheels or the plurality of rear wheels being driven, a grading blade extending from the frame toward the surface underlying the motor grader, a user interface portion configured to obtain user input, a plurality of blade articulation structures adapted to articulate the blade relative to the frame, a plurality of sensors, an articulation mechanism, a steering mechanism, at least one power source linked to one or more of the wheels to provide propulsion input; and a control system including at least one controller configured to perform an extraction procedure in which the at least one controller is configured to:

obtain a desired direction of motion of the motor grader from the first location toward the second location, receive signals from said plurality of sensors, determine a blade position via one or more of the sensors, and perform an automatic sequence of operations based on the desired direction of motion and the blade position to reposition one or more of the plurality of front wheels or the plurality of rear wheels to the second location of comparatively greater traction, the automatic sequence of operations including:

adjusting the blade position by at least one of raising the blade or pitching the blade back, steering the front wheels towards the first location of reduced traction, articulating the rear frame towards the second location, and providing propulsion in a rearward direction.

2. The system for extracting a motor grader according to claim 1, wherein the automatic sequence of operations includes at least one of:

identifying a desired relative articulation angle of the front and rear frames and providing an adjustment to a current relative articulation angle of the front and rear frames if the current relative articulation angle of the front and rear frames differs from the desired relative articulation angle of the front and rear frames, identifying a desired steering angle of the front wheels and providing an adjustment to a current steering angle if the current steering angle differs from the desired steering angle, identifying a desired position and disposition of the blade and providing an adjustment to at least one of a current position or a current disposition of the blade if at least one of the current position and of the blade differs from the desired position of the blade or the current disposition of the blade differs from the desired disposition of the blade, or identifying a desired direction of propulsion based upon a desired direction of motion of the motor grader and providing propulsion to one or more of the plurality of front wheels or the plurality of rear wheels.

3. The system for extracting a motor grader according to claim 2, wherein the plurality of sensors includes one or more of a blade sideshift sensor, a blade pitch sensor, a left blade lift sensor, a right blade sensor, a circle rotation sensor, a drawbar centershift sensor, a linkbar pin position sensor, an articulation sensor, a steering angle sensor, a drawbar IMU, a yoke IMU, a body IMU, or a blade IMU.

4. The system for extracting a motor grader according to claim 3, wherein determining the position of the blade includes receiving at least one signal from at least one of the blade sideshift sensor, the blade pitch sensor, the left blade lift sensor, the right blade sensor, the circle rotation sensor, the drawbar centershift sensor, the linkbar pin position sensor, the articulation sensor, the steering angle sensor, the drawbar IMU, the yoke IMU, the body IMU, or the blade IMU, the controller further being configured to determine if articulation of the blade will result in machine damage.

5. The system for extracting a motor grader according to claim 1, wherein the plurality of blade articulation structures include at least one of a blade sideshift solenoid, a blade pitch solenoid, a left blade lift solenoid, a right blade lift solenoid, a circle rotation solenoid, or a drawbar centershift solenoid, the system further including at least one articulation solenoid, and at least one steering solenoid, and the extraction procedure includes providing at least one signal to the at least one of the blade sideshift solenoid, the blade pitch solenoid, the left blade lift solenoid, the right blade lift solenoid, the circle rotation solenoid, the drawbar centershift solenoid, the articulation solenoid, or the steering solenoid.

6. The system for extracting a motor grader according to claim 1, wherein the control system is configured to receive at least one signal from the user interface including the desired direction of motion of the grader.

7. The system for extracting a motor grader according to claim 1, wherein the control system is configured with a plurality of machine configuration parameters.

8. The system for extracting a motor grader according to claim 1, the motor grader further including a drawbar, wherein the at least one controller is configured to receive signals from the plurality of sensors, and the extraction procedure includes:

if the rear frame is positioned other than substantially perpendicular to the front frame, repositioning the blade at a substantially perpendicular position relative to the front frame, if the frame is not pitched back, pitching the blade back, lowering the blade to raise the front wheels off of the surface, shifting at least one of the blade or the drawbar towards the first location of reduced traction to move the front wheels toward the second location of increased traction, raising the blade and pitching the blade back, turning the front wheels towards the first location of reduced traction, and providing propulsion in a rearward direction.

9. The system for extracting a motor grader according to claim 1, the motor grader optionally including a drawbar, wherein the at least one controller is configured to receive signals from the plurality of sensors, and the extraction procedure includes:

if the rear frame is positioned other than substantially perpendicular to the front frame, repositioning the blade at a substantially perpendicular position relative to the front frame, if the frame is not pitched back, pitching the blade back, lowering the blade to raise the front wheels off of the surface, shifting at least one of the blade and the drawbar towards the first location of reduced traction to move the front wheels toward the second location of increased traction, raising the blade, rotating the blade forward toward the first location of reduced traction and lowering the blade onto the surface to engage a heel of the blade with the first location of reduced traction, rotating the heel of the blade forward toward the second location of increased traction while articulating the rear frame towards the second location of increased traction, raising the blade and pitching the blade back, turning the front wheels towards the first location of reduced traction, and providing propulsion in a rearward direction.

10. The system of for extracting a motor grader according to claim 9, wherein the turning the front wheels toward the first location of reduced traction includes turning the front wheels to an articulation angle of the front wheels that is substantially the same as an articulation angle of the rear wheels.

11. A method of extracting a motor grader from a first location where wheel slippage occurs to a second location of comparatively greater traction, the motor grader having a front frame supported on a plurality of front wheels and a rear frame supported on a plurality of rear wheels, the front frame and rear frame being articulated relative to one another, one or more of the plurality of front wheels or the plurality of rear wheels being driven, the motor grader further including a blade for grading an underlying ground surface, the method comprising:

selecting, based on a direction from the first location to the second location, a desired direction of motion of the motor grader;

determining, via one or more sensors associated with the blade, a blade position including at least one of a blade sideshift, a blade pitch, a blade lift, a circle rotation, or a drawbar centershift;

initiating, based on the desired direction of motion and the blade position, a sequence of operations to be automatically executed by the motor grader to reposition one or more of the plurality of front wheels or the plurality of rear wheels, in to the second location of comparatively greater traction, the sequence of operations including:

adjusting the blade position by at least one of raising the blade or pitching the blade back, steering the front wheels towards the first location of reduced traction, articulating the rear frame towards the second location, and providing propulsion in a rearward direction.

12. The method of extracting the motor grader of claim 11, wherein adjusting the blade position further includes repositioning one or more of the plurality of front wheels or the plurality of rear wheels of the motor grader to a hard surface with improved traction.

13. The method of extracting the motor grader of claim 11, further including:

selecting a ditch extraction auto sequence mode; and activating, based on selecting the ditch extraction auto sequence mode, a ditch extraction auto sequence automatic control.

14. The method of extracting the motor grader of claim 11, wherein the sequence of operations further includes at least one of:

identifying a desired relative articulation angle of the front and rear frames and providing an adjustment to a current relative articulation angle of the front and rear frames if the current relative articulation angle of the front and rear frames differs from the desired relative articulation angle of the front and rear frames;

identifying a desired steering angle of the plurality of front wheels and providing an adjustment to a current steering angle if the current steering angle differs from the desired steering angle;

identifying a desired position and disposition of the blade and providing an adjustment to at least one of a current position of the blade or a current disposition of the blade if at least one of the current position or the current disposition of the blade differs from the respective desired position or disposition of the blade; or identifying, based on the desired direction of motion, a desired direction of propulsion of the motor grader, and providing, according to the desired direction of propulsion, propulsion to one or more of the plurality of front wheels or the plurality of rear wheels that are to be driven.

15. A controller for executing an extraction auto sequence for extracting a motor grader from a first location with reduced traction wherein wheel slippage occurs during grading of a surface underlying the motor grader to a second location of comparatively greater traction, the motor grader having a front frame supported on a plurality of front wheels and a rear frame supported on a plurality of rear wheels, the front frame and rear frame being articulated relative to one another, one or more of the front or rear wheels being driven, the motor grader further including a blade for grading an underlying ground surface, and a plurality of sensors, the controller being configured to:

receive signals from the plurality of sensors;

receive at least one signal including a desired direction of motion of the grader from the first location toward the second location;

determine the position of the blade via one or more sensors of said plurality of sensors; and provide signals to control structures of the motor grader to perform an automatic sequence of operations based upon a desired direction of motion and a desired blade position to reposition one or more of the plurality of front wheels or the plurality of rear wheels on the second location of comparatively greater traction, the automatic sequence of operations including:

adjusting the blade position by at least one of raising the blade or pitching the blade back, steering the front wheels towards the first location of reduced traction, articulating the rear frame towards the second location, and providing propulsion in a rearward direction.

16. The controller of claim 15, wherein the plurality of sensors includes one or more of a blade sideshift sensor, a blade pitch sensor, a left blade lift sensor, a right blade sensor, a circle rotation sensor, a drawbar centershift sensor, a linkbar pin position sensor, an articulation sensor, a steering angle sensor, a drawbar IMU, a yoke IMU, a body IMU, or a blade IMU, and the controller is further configured to provide signals to a plurality of solenoids associated with structures of the motor grader.

17. The controller according to claim 15, wherein the motor grader optionally includes a drawbar, and the automatic sequence of operations includes:

if the rear frame is positioned other than substantially perpendicular to the front frame, repositioning the blade at a substantially perpendicular position relative to the front frame, if the blade is not pitched back, pitching the blade back, lowering the blade to raise the front wheels off of the surface, shifting at least one of the blade and or the drawbar towards the first location of reduced traction to move the front wheels toward the second location of increased traction, raising the blade and pitching the blade back, turning the front wheels towards the first location of reduced traction, and providing propulsion in a rearward direction.

18. The controller according to claim 15, wherein the motor grader further includes a drawbar, and the extraction procedure includes:

if the rear frame is positioned other than substantially perpendicular to the front frame, repositioning the blade at a substantially perpendicular position relative to the front frame, if the blade is not pitched back, pitching the blade back, lowering the blade to raise the front wheels off of the surface, shifting at least one of the blade or the drawbar towards the first location of reduced traction to move the front wheels toward the second location of increased traction, raising the blade, rotating the blade forward toward the first location of reduced traction and lowering the blade onto the surface to engage a heel of the blade with the first location of reduced traction, rotating the heel of the blade forward toward the second location of increased traction while articulating the rear frame towards the second location of increased traction, raising the blade and pitching the blade back, turning the front wheels towards the first location of reduced traction, and providing propulsion in a rearward direction.

* * * * *